United States Patent [19]

Salem

[11] 4,229,811

[45] Oct. 21, 1980

[54] INTRUSION DETECTION METHOD AND APPARATUS

[75] Inventor: Robert J. Salem, Danbury, Conn.

[73] Assignee: General Electric Company, New York, N.Y.

[21] Appl. No.: 959,105

[22] Filed: Nov. 9, 1978

[51] Int. Cl.[3] ..... G08B 13/16

[52] U.S. Cl. ..... 367/93

[58] Field of Search ..... 340/558, 559, 552, 553, 340/1 R, 1 C; 343/5 PD; 367/93, 94

[56] References Cited

U.S. PATENT DOCUMENTS

| | | | |
|---|---|---|---|
| 3,255,434 | 6/1966 | Schwarz | 340/16 R |
| 3,431,549 | 3/1969 | Tullio et al. | 340/1 R |
| 3,898,640 | 8/1975 | Hossbach | 340/559 |

*Primary Examiner*—David L. Trafton
*Attorney, Agent, or Firm*—George R. Powers; Carlos Nieves; Leonard J. Platt

[57] ABSTRACT

An improved method and apparatus for carrying the method are disclosed which provide for selection by the user of a surface used as a reference in the detection of an intrusion. This is achieved by periodically projecting pulses of acoustical energy from a source towards a reference surface and detecting the reflection of such pulses of acoustical energy at a receiver and providing a first indication or signal representative of the reflected pulses. A second indication or signal is generated which is adjustable and representative of the time elapsed between the projection of a pulse of acoustical energy from the source and the reception at the receiver of the pulse of acoustical energy when reflected from the selected reference surface. The variations between the first and second indications are detected and compared and an alarm is generated when a variation is detected in the indications. In the embodiment disclosed, the absence of variations between the first and second indications is measured by the coincidence of the first and second indications.

11 Claims, 9 Drawing Figures

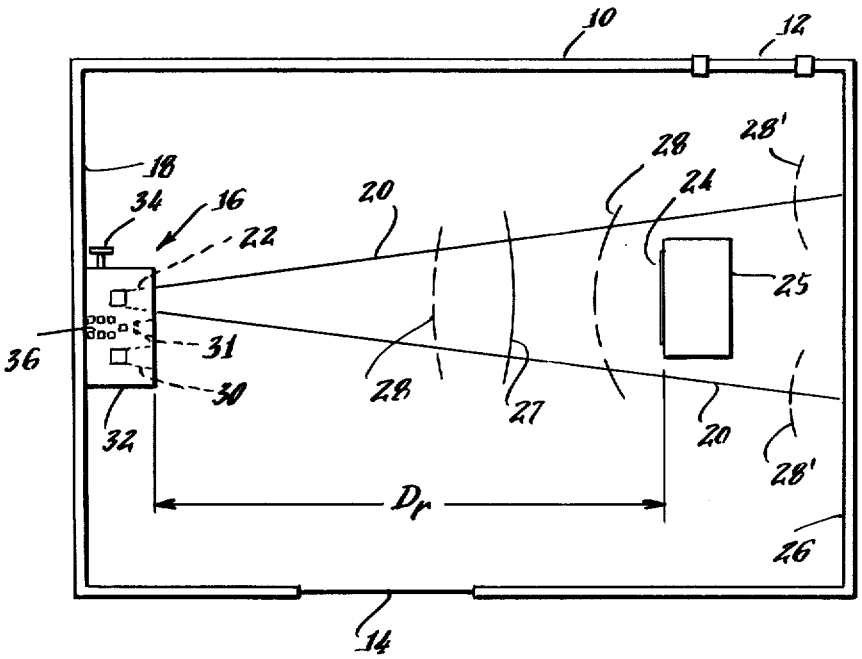
Fig. 1.
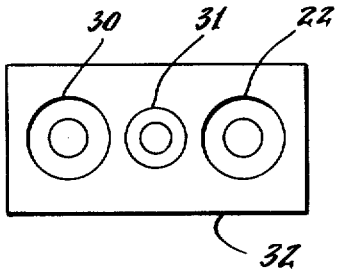
Fig. 2.
Fig. 7.
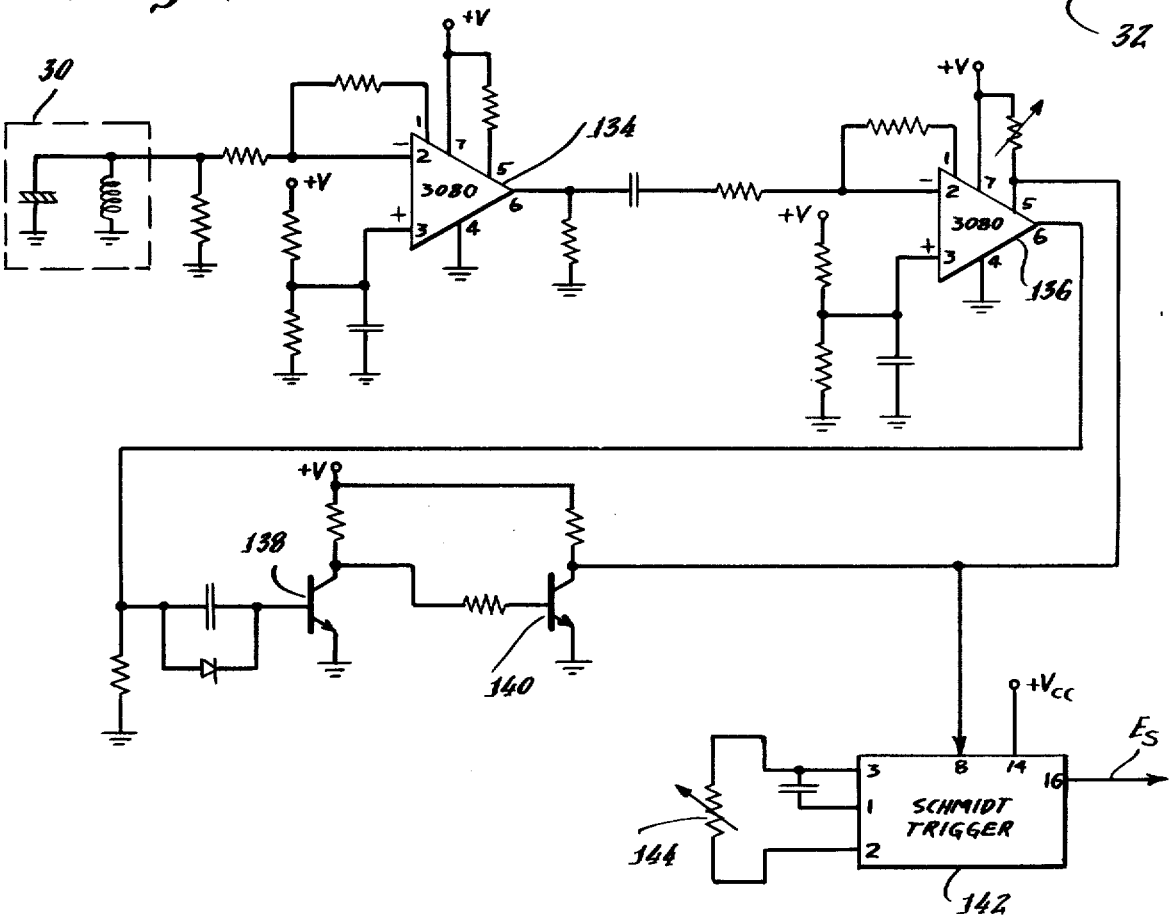

CLOCK PULSE GENERATOR
40
$E_c$
(fo) OSCILLATOR
42
$E_f$
DRIVER
44
22
38
SELECT REFERENCE SURFACE 34
VARIABLE PULSE WIDTH MULTIVIBRATOR
53
$E_c$
$E_a$
REF. SIG. GENERATOR
54
$E_{REF.}$
41
RECEIVER
46
30
43
SCHMIDT TRIGGER
49
$E_{REC.}$
$E_s$
COINCIDENCE GATE
56
$E_c$ RESET
ALARM F.F.
59
COINCIDENCE INDICATOR
60
ALARM GATE
62
ALARM LATCH
64
ALARM DELAY
66
67
DELAY
INST.
68
61
ALARM HORN
31
ALARM DRIVER
74
ALARM ENABLE
70
ALARM OSCILLATOR
72
$E_c$
69

INTRUSION DETECTION METHOD AND APPARATUS

BACKGROUND OF THE INVENTION

1. Field of the Invention

This invention relates to intrusion alarms. The invention relates more particularly to an improved, ultrasonic, pulse-echo method and apparatus for detecting the presence of an intruder in a protected space or for detecting certain other environmental changes.

2. Description of the Prior Art

Pulse-echo techniques are known for object detection wherein a pulse of acoustical energy is projected by a transducer and the occurrence of a pulse of reflected acoustical energy within a predetermined time interval is indicative of the presence of an object in an area being examined. Prior pulse-echo object detecting apparatus, however, have been relatively complex and costly and do not readily lend themselves to use as intrusion alarm detectors.

An improved pulse-echo method and apparatus for the detection of intrusions and other environmental changes is disclosed in my copending U.S. Patent Application Ser. No. 959,236 filed concurrently herewith and entitled IMPROVED INTRUSION DETECTION METHOD AND APPARATUS. In the method and apparatus disclosed in this copending application, pulses of acoustical energy are projected in a narrow beam at a reference surface and reflections of acoustical energy are detected. Any activities or environmental changes which alter a reflection from the reference surface are detected and an alarm is sounded.

As further disclosed in the copending application, the narrow beam of acoustical energy is projected at the reference surface and the range or distance of the reference surface from the apparatus is automatically determined and utilized as a parameter in sensing intrusions or other environmental changes. In general, the apparatus will automatically range on a dominant, larger, and substantially planar surface in an area to be protected, such as a wall surface.

Under certain circumstances, it is preferable to range on a specific target or object. For example, the particular arrangement of doors, windows and furnishings in an individual home may render it preferable to range on a particular reference object such as a bureau, a TV set, a chair, a door, a window, or the like. Although selection of a particular reference object can be accomplished with automatic ranging by the proper location of the pieces with respect to the detection apparatus, at times the reorientation of the object cannot be readily provided or the object cannot be separated sufficiently from proximity with a more dominating reference surface. It would be advantageous to enable the user of the intrusion detector to select a specific reference object without necessitating the orientation or rearrangement of objects.

SUMMARY OF THE INVENTION

Accordingly, it is a principal object of the present invention to provide an improved pulse-echo method and apparatus for detecting the occurrence of intruding objects or environmental changes in a protected area.

Another object of the invention is to provide an improved pulse-echo intrusion detection method and apparatus of the type which ranges on a reference surface.

Another object of the invention is to provide an improved pulse-echo detection method and apparatus for ranging on a selected reference surface.

Another object of the invention is to provide an improved intrusion detection method and apparatus of the pulse-echo type which enables a user to select a desired reference surface upon which the apparatus will range.

A further object of the invention is to provide a pulse-echo method and apparatus which discriminates between acoustical energy reflected from a desired reference surface and from other surfaces in an area to be protected.

Briefly, the method of this invention in its general aspects provides for projecting pulses of periodically recurring, ultrasonic acoustical energy from a source means toward a surface selected by the user as a reference surface; detecting reflections of the acoustical energy at a receiving means and providing a first indication of the detection. The first indication is representative of time elapsed ($T_e$) between projection of a pulse of acoustical energy from the source means and detection of a reflected pulse of acoustical energy at the receiving means. The time ($T_e$) initially corresponds to reflections from the reference surface 24 but is subject to variation upon an intrusion or environmental change. A second, reference indication which is derived from the initial first indication ($T_e$), is provided. The second indication is representative of the time elapsed ($T_r$) between the projection of acoustical energy from the source means and the reception of acoustical energy which is reflected from the reference surface. The reference indication is initially established by the user through a manually adjustable means. A variation between the first and second indications represents an intrusion or other environmental change to be sensed. The variation is detected and an alarm is generated.

In accordance with a preferred embodiment of the method of the invention, the apparatus is oriented for projecting pulses of acoustical energy at a selected reference surface. The first electrical indication comprises a sequence of electrical signals which are generated at the receiving means in response to detection of reflected energy. The pulse sequence has a period ($T_e$) representative of the time elapsed between projection and reception of a pulse of acoustical energy at the receiving means. A second sequence of periodically recurring electrical signals is generated. The period of the signals of the latter sequence is initially varied by the user during a set-up mode through a manual circuit adjustment to establish coincidence in time between the first and second signal sequences. In an operating mode, an anti-coincidence between the signal sequences represents an intruding condition; an anti-coincidence is detected; and, an alarm is generated.

The method provides for a start-up mode, a delayed mode and an operating mode. In the start-up mode, the alarm is inhibited and the user adjusts the period of ($T_r$) of the second signal sequence in order to bring these signals into coincidence with the first sequence of signals. During this mode, the acoustical pulses are reflected from the reference surface and ($T_r$) is equal to ($T_e$). In the delayed mode, the alarm is inhibited for a limited interval of time in order to allow the user to vacate the area to be protected. In the operating mode, upon detection of an anti-coincidence between the signal sequences, an alarm is sounded.

An apparatus in accordance with the invention in its more general aspects comprises the combination of: a source means for periodically projecting a pulse of ultrasonic, acoustical energy toward a reference surface, and a receiving means for detecting the reflection of acoustical energy and for providing a first indication of the detection. A second, reference indication means is provided which provides an indication which is representative of a period of time elapsed between the projection of an acoustical energy pulse by the source means and the reception of a reflected pulse from the reference surface. The reference indication means is adapted to adjustably establish the reference indication to conform with the initial, first indication through a manually selectable means at the receiver thereby enabling the user to select a preferred reference surface. Means are provided for comparing the first and second indications and for generating an alarm in the absence of an equality between these indications.

A preferred embodiment of the apparatus of the invention comprises a means for generating a first sequence of electrical signals representative of reflected pulses of acoustical energy, an adjustable means for establishing a second, reference sequence of periodically recurring electrical signals, a means for detecting anti-coincidence between the first and second sequence of signals, and an alarm means for generating an alarm upon detection of an anti-coincidence.

BRIEF DESCRIPTION OF THE DRAWINGS

These and other objects and features of the invention will become apparent with reference to the following specification and to the drawings wherein:

FIG. 1 is a fragmentary, schematic plan view of an area to be protected from intrusion and which illustrates the method and apparatus of the invention;

FIG. 2 is an enlarged, side elevation view of an intrusion apparatus of FIG. 1;

FIG. 7 is a schematic diagram of a receiver-amplifier of FIG. 3;

DETAILED DESCRIPTION

Figure 3:
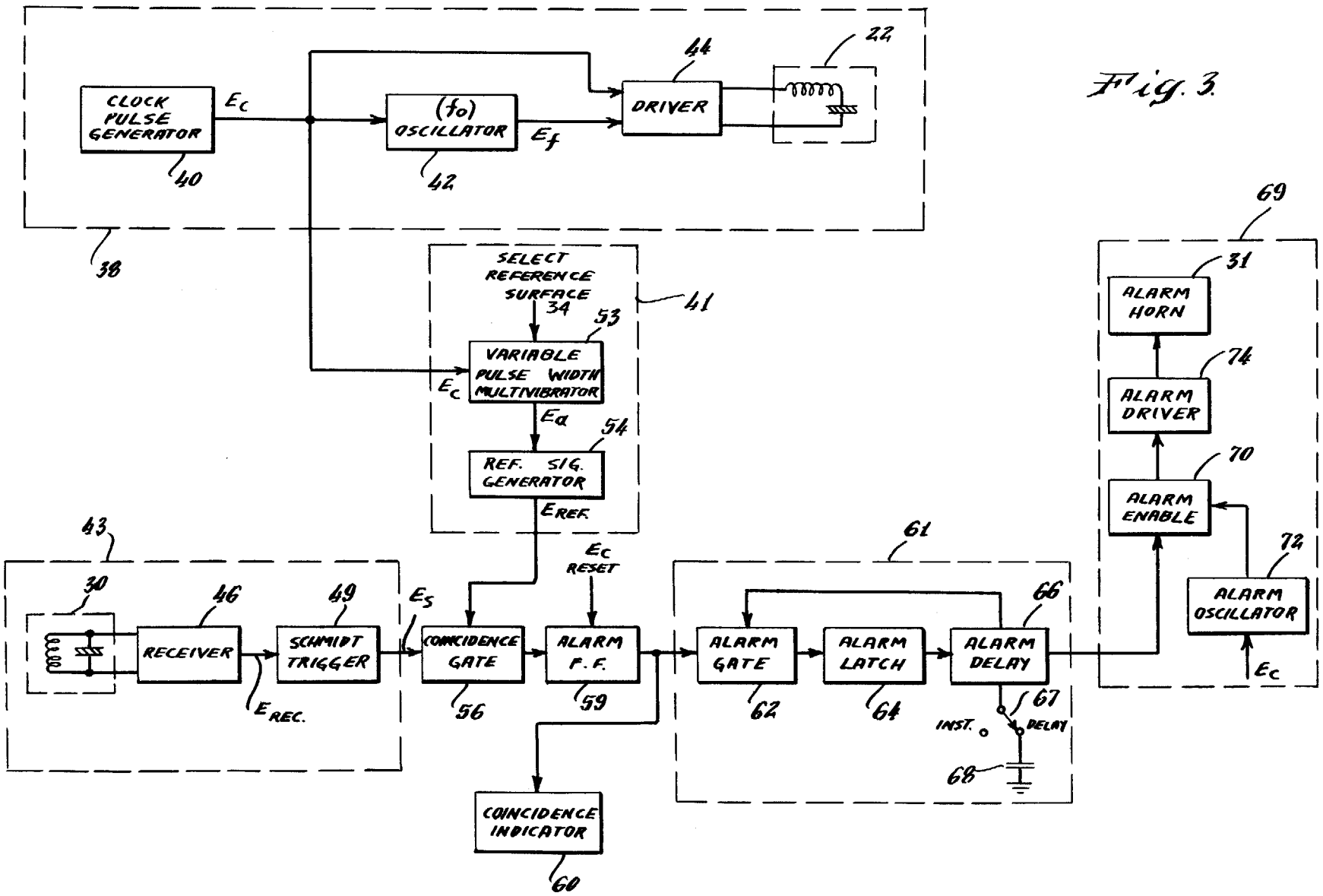
FIG. 3 is a block diagram illustrating the apparatus of the invention.

A pulse-echo method and apparatus for establishing intrusion detection in accordance with this invention is illustrated generally in FIG. 1 which is a plan view of an area to be protected. The area comprises a room 10 having various means of ingress and egress, such as a door 12 and a window 14. The apparatus of the invention reference generally as 16, is shown positioned adjacent a room wall 18 at a convenient elevation. A generally conically shaped narrow beam 20 of acoustical energy is projected from a source means of the apparatus 16. The beam is projected from a transmitting transducer 22 toward a reference surface comprising a flat surface 24 of a body 25 which, for example, comprises a television receiver, a bureau, a chair, etc. The body 25 is spaced from a relatively larger wall surface 26. Projected acoustical energy, represented by the curved wave front 27, impinges upon the reference surface 24 and is reflected therefrom.

Beam 20 is generally conically shaped upon projection and, at the distance ($D_r$) of the body 25 from the apparatus 16, the beam is shown to be larger in cross section than is this body. A part of the projected acoustical energy will thus be transmitted beyond the object 25 and will impinge upon the wall surface 26. The energy impinging on the wall surface 26 is also reflected. The dashed curve 28 represents acoustical energy reflected from the surface 24 and the dashed curved 28' represents acoustical energy reflected from the wall surface 26.

Reflected acoustical energy is sensed by a receiver means of the apparatus 16. Acoustical energy incident on a receiving transducer 30 causes electrical signals to be generated which are representative of the received energy. The transmitting and receiving transducers 22 and 30 respectively and an alarm horn 31 are shown mounted in juxtoposed relationship in a housing member 32 of the apparatus 16. Alternatively, the transmitting and receiving transducers can be positioned at spaced apart locations, insofar as the receiver is oriented for receiving reflected energy.

The intrusion detection apparatus 16 is a pulse-echo type of apparatus wherein pulses of ultrasonic acoustical energy ($E_f$) (FIG. 4) are periodically projected to, and reflected from, the reference surface 24. A first indication of the projection and detection of reflected pulses comprises a sequence of electrical signals ($E_s$) (FIG. 4) which is generated by the receiving means. Each signal of the sequence is representative of reception of a reflected pulse of energy. A time interval which elapses between projection and reflection of a pulse is ($T_e$). A time interval which elapses between the projection toward and reflection of a pulse from the reference surface 24 over distance $2(D_r)$ is referred to as the reference time ($T_r$). As described in greater detail hereinafter, a sequence ($E_{ref}$) (FIG. 4) of periodically recurring reference signals 57 are generated by the apparatus 16. The period ($T_r$) between the recurring reference signals is initially established to provide that the pulses 57 occur every ($T_e$) so that upon synchronization of the two signal sequences ($E_s$) and ($E_f$) the signals will occur coincidentally in time. After the pulse period ($T_r$) has been established, the apparatus 16 will thereafter, in the absence of an intrusion or other environmental change, continuously indicate a coincidence in time between the sequence ($E_{ref}$) of locally generated reference signals and the sequence ($E_s$) of signals representing reflected acoustical energy. An absence of coincidence is indicative of an alarm condition. More particularly, the presence of an intruding body in the area of the cone of energy 20 between the apparatus 16 and the reference surface 24 will cause the reflected energy from the surface 24 to be attenuated and interfere with the reflection toward the receiver 16, or alternatively, will cause a premature reflection of energy from the body itself toward the apparatus 16. In either case, the sequence of signals representative of reflected energy from the source 24 will be altered, an anti-coincidence between the sequence ($E_{ref}$) of reference signals and the sequence ($E_s$) of received signals will be indicated and an alarm will be provided. Similarly, removal or repositioning of the object 25 itself will also cause the sequence of received signals to be displaced in time resulting in an alarm condition. It should be noted that the beam 20 can be projected at a door or window which functions as a reference surface and movement of the door or the window will similarly create an alarm condition. In general, the introduction of an intruding body between the apparatus 16 and a reference surface, or, a change in the environmental condition of the area to be protected such as the opening and closing of a door or window will cause an alarm to be sounded.

Advantageous features of the method and apparatus of this invention provide for user selection of a particular reference surface upon which the apparatus 16 ranges, and, received signal discrimination. The apparatus 16 is adapted to vary the period ($T_r$) of the second sequence ($E_{ref}$) of signals to establish coincidence between this second sequence and the first sequence ($E_s$) of signals. More particularly, in the arrangement illustrated in FIG. 1, the receiving means will receive reflections both from the reference surface 24 and from the wall surface 26. By adjusting the reference period ($T_r$) the user can establish coincidence between ($E_{ref}$) and the initial signals ($E_s$) which are projected and reflected from surface 24 thus establishing the surface 24 as the reference surface. The apparatus 16 will discriminate between pulses reflected from the reference surface 24 and pulses reflected from other surfaces. Apparatus 16 senses for the occurrence of pulses 50 (FIG. 4) reflected from the reference surface 24 which are in time coincidence with the signal pulses 57 and discriminates against other pulses 51 occurring in the interval between the repetitively occurring reference pulses.

The apparatus 16, in a preferred embodiment, has three modes of operation. In an initial start-up mode, the audible alarm 31 is inhibited and the user adjusts a control knob 34 which causes the period ($T_r$) between references pulses to vary until coincidence is obtained between the signal sequences ($E_{ref}$) and ($E_s$). During the start-up mode of operation, a visual indication of anti-coincidence between the signal sequences ($E_{ref}$) and ($E_s$) is provided by display 36 (FIG. 1) until such time as adjustment of the control knob 34 establishes coincidence in time between these signal sequences. The visual display light 36 which is automatically illuminated during anti-coincidence remains illuminated until adjustment of the knob 34 causes coincidence between the pulses 50 and 57. At such time, the apparatus is enabled for intrusion detection and is then switched into a delay mode by the user. In the delay mode of operation, sounding of an audible alarm is delayed for an interval of time in order to enable the user to vacate the area without generating an alarm as a result of his movements. Upon termination of the delay mode, the apparatus 16 automatically switches into an operating mode during which an audible alarm will be sounded when an anti-coincidence condition is detected.

Figure 4:
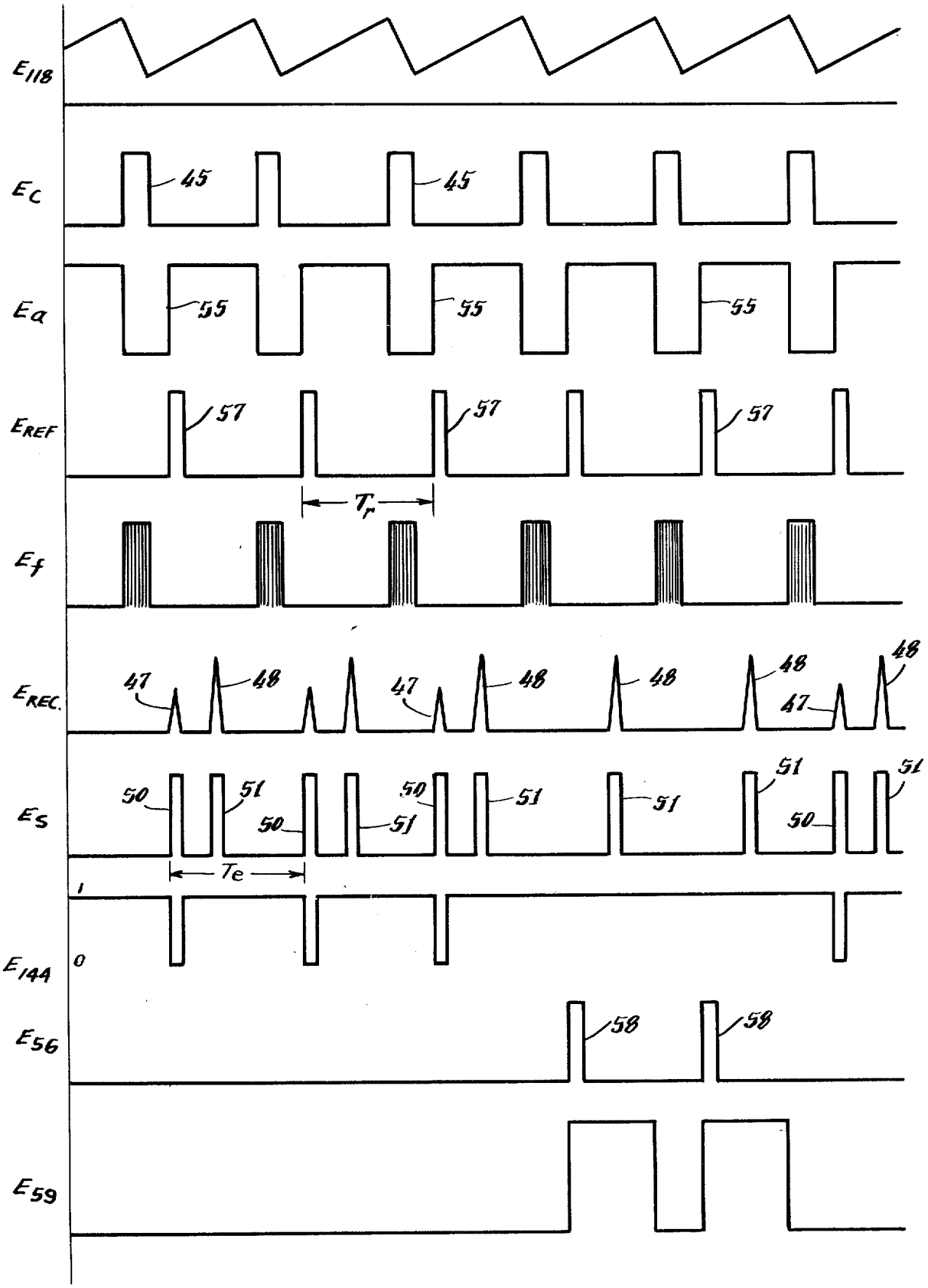
FIG. 4 is a diagram illustrating electrical waveforms occuring at various circuit locations of the apparatus of FIG. 3.

The arrangement of the apparatus 16 of FIGS. 1 and 2 is illustrated in the block diagram of FIG. 3. An acoustical signal source means, shown within the dashed rectangle 38, comprises a clock pulse generator 40, an ultransonic oscillator 42, and a transducer driver 44 for driving the transmitting transducer 22. This transducer is represented in FIG. 3 by the equivalent circuit of a series coupled inductance and crystal. Clock pulse generator 40 generates a signal ($E_c$) comprising periodically recurring output pulses as illustrated in FIG. 4. The clock pulses which recur, for example at a PRR of 12 Hz, periodically enable the oscillator 42. This oscillator provides an alternating output signal at a relatively low ultrasonic frequency ($f_o$) such as 24 KHz. The oscillator output signal ($E_f$) (FIG. 4) along with the clock pulse signal ($E_c$) are applied to the transducer drive 44 for periodically exciting the transducer 22 at the frequency ($f_o$). The transducer 22 projects a narrow beam 20 (FIG. 1) of acoustical energy at the reference surface 24.

A receiving means shown within the dashed rectangle 43 is provided for receiving pulses of reflected energy and for generating a sequence of signals representative of the received acoustical pulses. The receiving transducer 30 which is represented in FIG. 3 by an equivalent circuit of a parallel coupled inductance and crystal is excited by the acoustical energy incident thereon. An electrical signal, representative of incident acoustical energy is generated by the transducer and is coupled to a receiver 46 for pre-amplification and amplification to provide a receiver output signal ($E_{rec}$). The receiver signal ($E_{rec}$) is supplied to a level sensing, signal squaring circuit comprising a Schmidt trigger 49 which generates an output signal ($E_s$).

As indicated hereinbefore, acoustical energy which is reflected from the reference surface 24, is indicated in FIG. 1 by the dashed wave front 28 and acoustical energy which is reflected from the wall surface 26 rearward of the object 25 is represented by the wave fronts 28'. Acoustical energy 28 reflected from surface 24 travels a shorter distance than the energy 28' reflected from the surface 26 and the reflections from the surface 24 will be incident on the transducer 30 prior to reflections from the surface 26. As illustrated in FIG. 4, the signal ($E_{rec}$) includes a signal component 47 representative of the reflection of acoustical energy from the surface 24 and a larger signal component 48 occurring subsequently in time and representative of the reflection of acoustical energy from the surface 26. The Schmidt trigger output pulses 50 and 51 (FIG. 4) correspond to the received signals 47 and 48 respectively.

A circuit means for generating a second sequence of reference signals representative of the elapsed time interval ($T_r$) is shown within the dashed rectangle 41 and comprises a variable pulse width multivibrator 53 and a reference signal generator 54. An input signal to the multivibrator 53 comprises the clock pulse ($E_c$) and an output thereof comprises a square wave signal ($E_a$) as illustrated in FIG. 4. Adjustable circuit means vary the time occurrence of a leading edge 55 of a positive going segment of the multivibrator signal ($E_a$) which triggers the reference signal generator 54. This generator comprises a one-shot multivibrator which is triggered to generate a plurality of periodically recurring reference signal pulses 57 as illustrated in FIG. 4.

A means for detecting anti-coincidence between the first and second sequences of signals ($E_s$) and ($E_{ref}$) is provided and is shown to comprise an anti-coincidence gate 56. Coincidence between the signal sequences is initially established during a start-up mode by varying the period ($T_r$). The selected reference surface comprises the surface 24 and the sequence of pulses 50 of the signal ($E_s$) are represenative of the received reflections of acoustical energy from this surface. The period ($T_r$) is varied, as indicated in more detail hereinafter, by altering the duty factor of the multivibrator signal ($E_a$) in order to vary that point in time at which the leading edge 55 occurs. After initially establishing coincidence between the sequence of reference pulses 57 and the sequence of reflected signal pulses 50, these signals which are applied to the anti-coincidence gate 56, inhibit an output until such time as a pulse 50 fails to occur. A pulse 50 will fail to occur when an intrusion occurs or an environmental change occurs as indicated hereinbefore. The pulse train of the signal ($E_a$) of FIG. 4, for illustrative purposes, shows the absence of pulses 50 in the sequence of signal ($E_s$). A signal ($E_{56}$) will then be provided, as indicated by the output pulses 58 of FIG. 4. The pulses 58 are coupled to an alarm latch 59 which is set by these pulses and which is reset by the clock pulses ($E_c$). An alternating output signal ($E_{59}$) is provided by the alarm latch 59 during anti-coincidence. The signal ($E_{59}$) as shown ir FIG. 4, is applied to a coincidence indicator means 60 for providing a visual anti-coincidence indication to the user. During adjustment of the period ($T_r$) by the user, the indicator means 60 indicates to the user when reference pulses 57 are in time coincidence with the sequence of received pulses 50. Prior to establishing ($T_r$), an anti-coincidence condition will exist; the pulses 58 will be generated; and, the output signal ($E_{59}$) will cause a visual indication and an audible indication in an operate mode. When the period ($T_r$) is manually adjusted by the user to the value which establishes coincidence between the sequence of reference pulses 57 and the sequence of pulses 50, an output from the coincidence gate 56 will be inhibited and an audible or visual anti-coincidence indication will be terminated.

An alarm delay means, represented by components within the dashed rectangle 61, is shown to comprise an alarm gate 62, an alarm latch 64, an alarm delay circuit 66, and a delay switch 67. Upon the detection of an intruding condition and the generation of the anti-coincidence pulses 58, the alarm latch signal will enable the gate 62 and set the alarm latch 64. Setting of the alarm latch is initially inhibited during the start-up mode and subsequently thereafter during a delay mode. A delay or instantaneous alarm mode can be selected by the user with the switch 67 which, as indicated in greater detail hereinafter, couples a delay capacitance 68 to the alarm delaying circuit means 66.

An alarm means, shown within the dashed rectangle 69, is provided and generates an alarm in response to an output from the alarm delay means 61. An output signal is generated by an alarm enable circuit 70 to which is coupled an enabling input signal from alarm delay 66 and the output of an alarm exciting oscillator 72. An output signal of the oscillator 72 is applied by enable circuit 70 and alarm driver 74 to the alarm horn 31 for generating an audible indication of an intrusion.

Figures 5, 6:
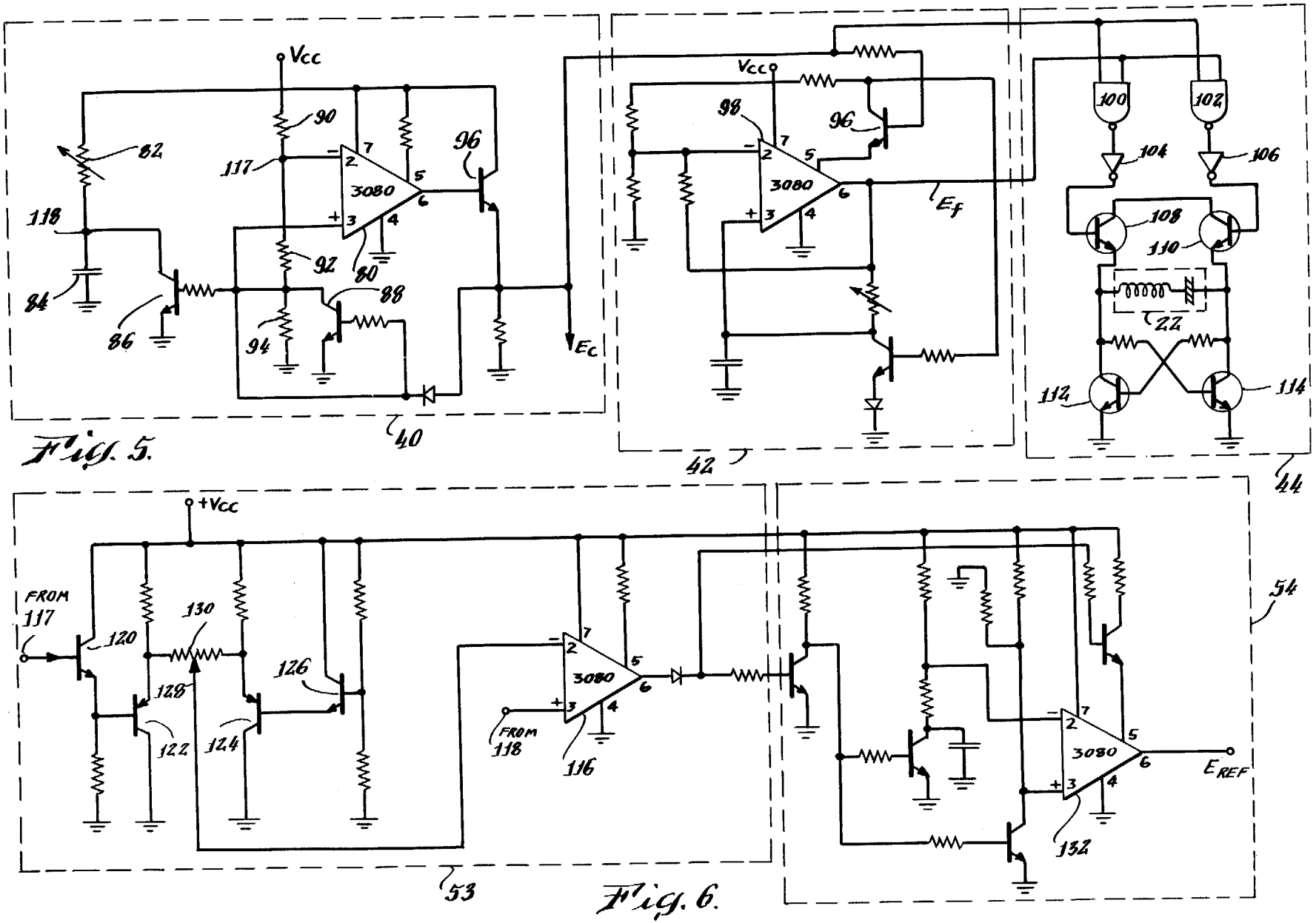
FIG. 5 is a schematic diagram of a clock pulse generator and transmitting transducer, oscillator and driver of FIG. 3.
FIG. 6 is a schematic diagram of a variable pulse width generator and a reference signal generator of FIG. 3.

Components of the block diagram of FIG. 3 will now be described in greater detail with reference to FIGS. 5 through 9. The clock pulse generator 40 is shown in FIG. 5 to comprise an oscillator formed by a differentially coupled operational amplifier 80 to which a sawtooth voltage is applied from an RC circuit comprising an adjustable resistance 82 and a capacitance 84. Clock pulses are coupled in a feedback network via the transistors 86 and 88 and discharge the capacitance 84 to terminate the pulse until the capacitance 84 recharges to a predetermined level. A reference voltage is established by a divider comprising resistances 90, 92 and 94. Output clock pulses are applied to the oscillator 42 via a transistor 96 for enabling the oscillator. The oscillator comprises an operational amplifier 98 coupled as a multivibrator and adapted to oscillate at an ultrasonic frequency of, for example, about 24 KHz. The clock pulse signal ($E_c$) and the oscillator output signal ($E_a$) are applied by Nor gates 100 and 102 and associated inverter amplifiers 104 and 106 to a totem pole driver for the transducer 22.

The variable pulse width multivibrator and reference generators 53 and 54 respectively, are illustrated in FIG. 6. The variable pulse width multivibrator comprises a differentially coupled operational amplifier 116 to which is applied a sawtooth voltage $E_{118}$ having a waveform as illustrated in FIG. 4. This voltage occurs at terminal 118 of the clock pulse generator of FIG. 5. A signal from a manually adjustable circuit means is also applied to the multivibrator. The latter comprises a range selecting bridge circuit configuration including transistor amplifiers 120, 122, 124 and 126. A clock pulse is derived from a tap 128 of a potentiometer 130 and is applied to the operational amplifier 116 for establishing a triggering level which determines the occurrence in time of the leading edge 55 of the multivibrator signal ($E_a$), as shown in FIG. 4. This output is coupled to a one-shot multivibrator provided by the operational amplifier 132. The one-shot circuit is triggered by the leading edge 55 and generates a timed output signal ($E_{ref}$) comprising sequence of pulses 57 as illustrated in FIG. 4.

The receiver 46 shown in FIG. 7 comprises operational amplifiers 134 and 136 which are coupled in a cascade, high gain configuration. A signal from the transducer 30 is applied to the operational amplifier 134 whereby it is amplified, further amplified by the amplifier 136 and squared by a squaring circuit comprising transistors 138 and 140. An output is coupled to a Schmidt trigger circuit 142 having an adjustable level selecting control 144 for selecting the triggering level.

Figure 8:
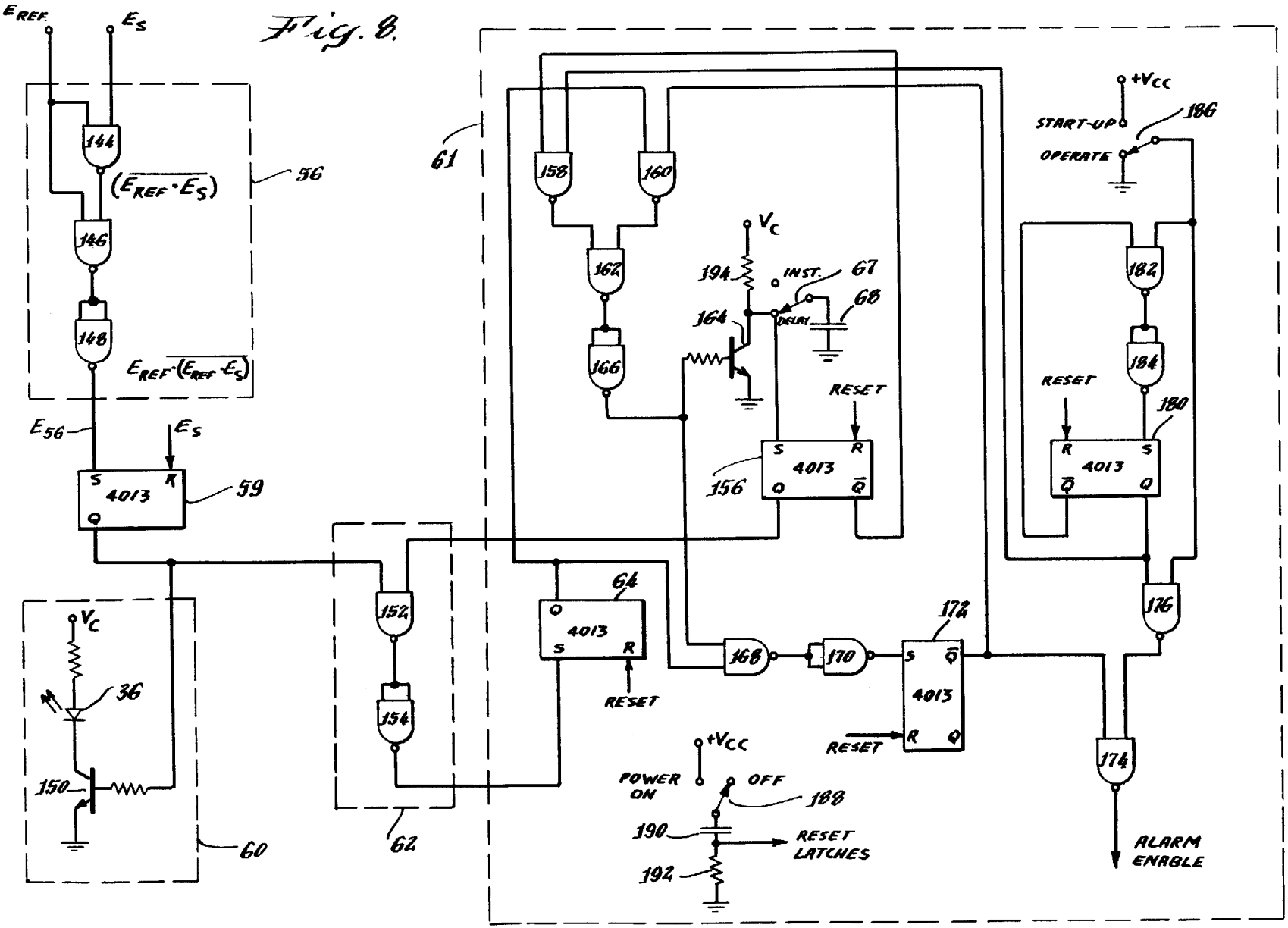
FIG. 8 is a logic diagram of an anti-coincidence detection and alarm means of FIG. 3; and, FIG. 9 is a schematic diagram of an alarm horn driver and exciting oscillator of FIG. 3.

The anti-coincidence gate 56 is shown in FIG. 8 to comprise Nand gates 144, 146 and 148. Input signals to gate 144 comprise the sequence of received signals ($E_s$) and the sequence of reference signals ($E_{ref}$). A logic level 1 output of the gate 144 (FIG. 4) indicates an absence of coincidence in time between these input signals. Since the signal ($E_{ref}$) is generally locally at the receiving means, an output of gate 144 indicates the absence or displacement in time of a return pulse and the existance of an intruding condition. The output of gate 144 along with the reference signals are applied to the gate 146 which, with Nand gate 148 operating as an inverting amplifier, provides an output ($E_{56}$) (FIG. 4) upon an anti-coincidence of the sequence of signals at the gate 144.

The alarm flip-flop 59 output is set by a signal from gate 148 and is applied to the anti-coincidence indicator 60. This indicator is shown to comprise a transistor 150 which drives the visual indicator 36 (FIG. 1). Indicator 36 is a light emitting diode. Upon the occurrence of an anti-coincidence condition, the flip-flop 59 is repeatedly set and reset. It is set by an output of gate 148 during the interval of the reference signal pulse 57, as illustrated in FIG. 4, and is reset by a subsequent clock pulse. The flip-flop 59 output is illustrated in FIG. 4. It is alternating and will continue to energize the light emitting diode via the transistor 150 as long as an anti-coincidence condition exists.

The alarm gate 62 of the alarm delay means 61 of FIG. 3 comprises a Nand gate 152 and a Nand gate operating as an inverting amplifier 154. Input to the gate 152 comprises the signal ($E_{59}$) and an output from a flip-flop 156 of the alarm delay 66. An output of the gate 154 sets the alarm latch 64 upon anti-coincidence.

The alarm delay 66 is shown to comprise a control gate arrangement including Nand gates 158 and 160 which provide inputs to a Nand gate 162. The output of the gate 162 is applied to the base electrode of an NPN delay transistor 164 through an inverting gate amplifier 166. The alarm delay further includes the Nand gate 168 and an inverting amplifier 170, the output of which sets a latch 172.

As indicated hereinbefore, during a start-up mode, it is desirable to adjust the period ($T_r$) in order to bring the sequence of reference signals into coincidence with the sequence of received signals without triggering an alarm. As this adjustment is being made, an intruding condition will be indicated by the output from the anti-coincidence gate 156. A circuit arrangement comprising a latch 180, control gates 182 and 184, and a start-up switch 186 is provided for disabling the delay alarm circuit during the start-up interval until the desired coincidence between the first and second sequence of signals is established by the user.

The sequence of logical operations performed by the delay means of FIG. 8 is best described by first considering the status of the circuit when the apparatus is in an operating mode. When power is initially applied to the apparatus through an on-off switch 188, a voltage spike appearing at the junction of capacitor 190 and a resistance 192 is applied to the latches 64, 156, 172 and 180 and resets each of these latches. Under these conditions, the transistor 164 will be maintained in a conductive state; its collector electrode will be near ground potential; the gate 168 will be inhibited from setting the latch 172; and, an alarm enable output from gate 174 will be inhibited. More particularly, in the selected delay alarm mode of operation, the capacitor 68 is coupled to the collector electrode of the transistor 164 via the switch 67. The transistor 164 is maintained conductive as a result of logic level 1 and 0 inputs to gate 158 from the reset latches 156 and 180 respectively, and 1 and 0 inputs to gate 160 from reset latches 172 and 64 respectively. At the same time, the gate 168 provides a 1 output as the result of a 0 input to this gate from the latch 64 and low input from the collector electrode of the transistor 164. Output gate 174 at this time exhibits a 0 output as a result of a 1 input from the latch 172 and from the gate 176. In an operating mode, switch 186 is coupled to a low potential such as ground potential as shown and the 0 input from the switch and a 0 input from the latch 180 causes a 1 output from the gate 176. This status of the various logical elements during an operating mode inhibits the generation of an output alarm enable insofar as a coincidence between the first and second sequence of signals continues to occur.

An anti-coincidence, indicative of an intruding condition, will cause a momentary output from the latch 59, thereby setting the alarm latch 64. A 1 output of this latch alters the logical input to the gate 158 and causes the transistor 164 to be switched to an off condition. When transistor 164 is turned off, the capacitance 68 charges to the voltage ($V_c$) at a rate determined by the time constant of this capacitance and a resistance 194. The desired delay in generating an alarm is accomplished as a result of this charging. When the capacitor has charged to a predetermined voltage, the gate 168 will then have two logic 1 inputs and an output from the gate 170 will set the latch 172. A 1 output from this latch will enable the gate 174 thereby generating an alarm enable signal which is applied to the alarm enable circuit 70 of FIG. 3. The latch 172 will remain latched in this condition until the apparatus is reset. Setting of latch 172 alters the logical input to the gate 160 thereby switching the transistor 164 into a conducting state and causing discharge of the capacitor 68. The transistor 164 will then be held in the conducting state.

In a start-up mode of operation it is desirable to inhibit the alarm while setting up the apparatus. This is accomplished by disabling gates 174 and 152 until coincidence between the first and second sequences of signals is established. During this mode, the switch 186 is switched by the user to a start-up terminal. Two logic 1 inputs to the gate 182 set the latch 180 thereby maintaining a 1 output from the gate 176. A 1 output from the latch 180 and a 1 output from the latch 156 causes a logic 0 output from the gate 158. A 0 input from latch 64 and a 1 input from latch 172 causes a 1 output from gate 160. The input to transistor 164 is then a logic 0 which causes the capacitor 68 to charge, set latch 156 and disable gate 152 by applying a logical 1 thereto. As latch 156 sets, the logical input to gate 158 is altered thereby driving transistor 164 to conduction and discharging the capacitance 68. The transistor 164 is maintained conductive during the start-up mode and 0 and 1 inputs will be applied to the gate 168 thereby inhibiting setting of the latch 172. Two logic 1 inputs to the gate 174 will thus be maintained and an output from the latter gate will be inhibited.

Upon establishing coincidence between the sequences ($E_{ref}$) and ($E_s$) the user switches switch 186 to the OPERATE terminal and a logic input is applied to the gate 174. This gate is then conditioned for an alarm indication from latch 172. A delay of the RC time constant is then provided before any alarm can be generated.

Figure 9:
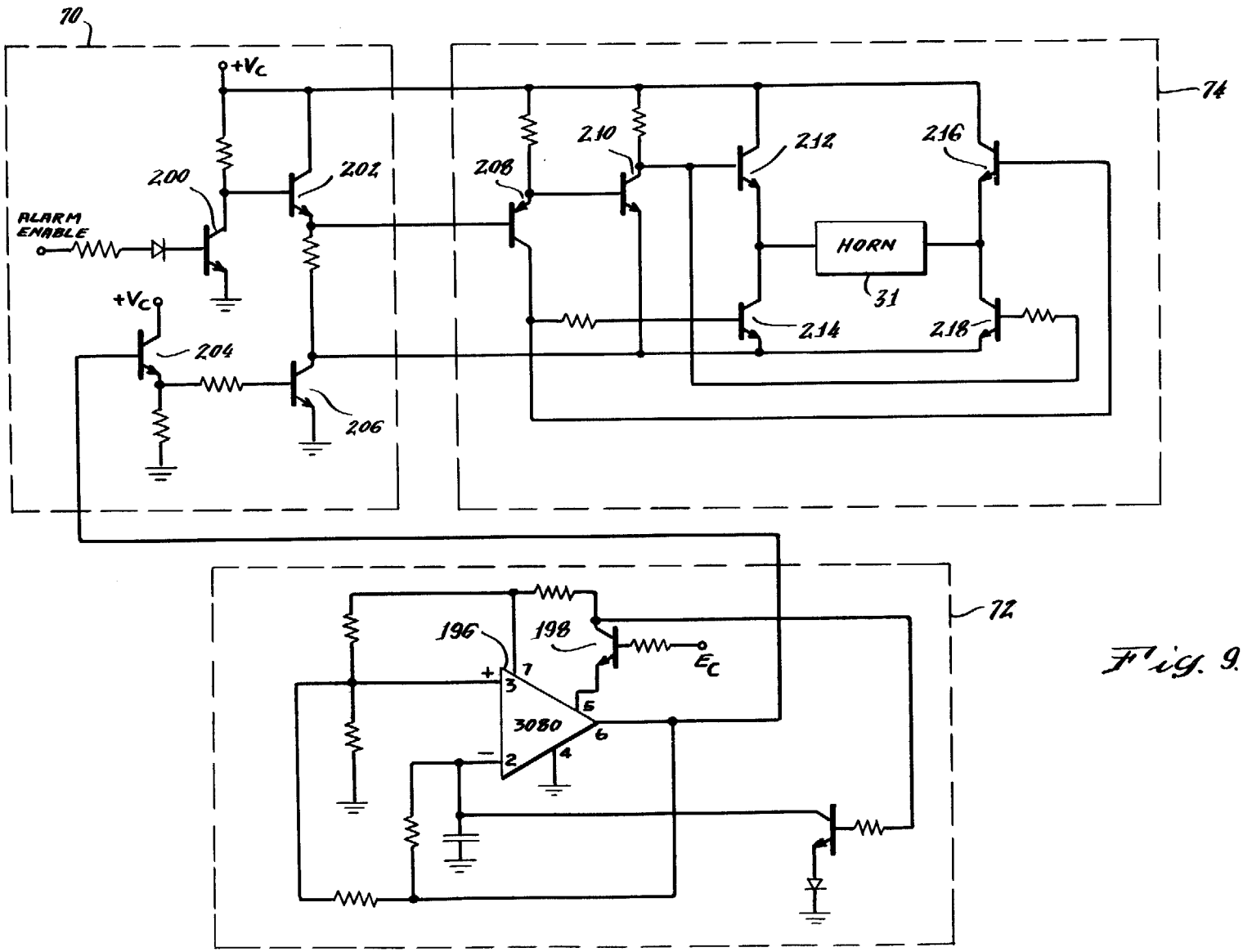

The alarm oscillator 72, as shown in FIG. 9, comprises a multivibrator oscillator formed by an operational amplifier 196 which oscillates at an audible frequency. An exemplary frequency is 3 KHz. The oscillator is enabled by a clock pulse input applied thereto via transistor 198. An output of this oscillator is applied along with an output from the alarm delay 66 to the alarm enable circuit 70. An input to the alarm enable circuit from the oscillator 72 is applied to a transistor amplifier configuration comprising the transistor 204 and an emitter follower 206. An enabling input to the circuit is applied via a transistor 200 and the transistor 202. In an enabled condition, the input audible oscillator signal is applied to the driver circuit arrangement 74 which comprises a totem pole driver including the transistors 208 through 218. The horn 31 is excited by this driver and sounds an audible alarm.

An improved intrusion detection method and apparatus has thus been described which advantageously enables a user to select a desired reference surface. A manually adjustable means is provided which enables the user to establish time coincidence between a sequence of locally generated periodically recurring reference signals and coincidence with a sequence of signals representative of reflected acoustical energy.

While there has been described a particular embodiment of the invention, it will be apparent to those skilled in the art that variations may be made thereto without departing from the spirit of the invention and the scope of the appended claims.

What is claimed is:

1. An improved method for detecting the presence of an intruding object or certain other environmental changes in a protected area, the method comprising the steps of:

(a) periodically projecting pulses of acoustical energy from a source means toward a reference surface;
(b) detecting a reflection of said projected pulses of acoustical energy at a receiving means and providing a first indication thereof;
(c) providing an adjustable second indication representative of time elapsed between the projection of a pulse from the source means and the reception at the receiving means of a pulse of acoustical energy reflected from the reference surface;
(d) detecting variations between said first and second indications; and,
(e) generating an alarm only upon detecting a variation.

2. An improved method for detecting the presence of an intruding object or certain other environmental changes in a protected area, the method comprising the steps of:
(a) periodically projecting pulses of acoustical energy from a source means to a reference surface;
(b) detecting a reflection of said pulses of acoustical energy at a receiving means and generating a sequence of electrical signals representative of said detected pulses;
(c) generating a second sequence of periodically recurring electrical signals having a period substantially equal to an interval of time elapsed during the projection of a pulse of acoustical energy from the source means and the reception of a reflected pulse from the surface at said receiving means;
(d) detecting a coincidence in time between the occurrence of said first and second signals; and,
(e) generating an alarm indication only in the absence of said coincidence.

3. The method of claim 2 including the step of adjusting the period of recurrence of said second signals for establishing coincidence in time between said signals.

4. The method of claim 3 including the step of manually adjusting a circuit means for establishing time coincidence between said first and second signals.

5. The method of claim 3 including the step of inhibiting the generation of an alarm in the absence of said coincidence, providing a second indication of the absence of said coincidence, and terminating said second indication upon adjustment of the period of recurrence when coincidence of said signals occur.

6. An improved apparatus for detecting the presence of an intruding object or certain other environmental changes in a protected area, comprising:
(a) source means for periodically projecting pulses of accoustical energy toward a reference surface;
(b) receiving means for detecting a reflection of said pulse of acoustical energy and provide a first indication thereof;
(c) means for generating an adjustable second indication representative of elapsed time between projection of said pulse and reception of a reflected pulse from said reference surface;
(d) means for detecting variations occurring between said first and second indication; and,
(e) means for generating an alarm upon detection of a variation.

7. An improved apparatus for detecting the presence of an intruding object or certain other environmental changes in a protected area comprising:
(a) source means for periodically projecting pulses of acoustical energy at a reference surface;
(b) receiving means for detecting a reflection of said pulses of acoustical energy and for generating a first sequence of electrical signals indicative of the reception of reflected pulses;
(c) adjustable means for generating a second sequence of periodically recurring electrical signals having a period substantially equal to an interval of time elapsed during the projection of a pulse of acoustical energy at said source means and the reception at the receiving means of a pulse reflected from said reference surface;
(d) means for detecting coincidence in time between said first and said second sequences of signals; and
(e) means for generating an alarm indication only in the absence of said coincidence.

8. The apparatus of claim 7 including means for adjusting the period of recurrence of said second sequence of signals for establishing coincidence in time between said first and second sequences of signals.

9. The apparatus of claim 8 wherein said means for generating said second sequence includes oscillator circuit means for generating periodically recurring pulses and adjustable circuit means for varying the period of said pulses.

10. The apparatus of claim 8 including means for providing an indication of anti-coincidence between said sequences of signals and for interrupting said indication upon coincidence of said sequences of signals.

11. The apparatus of claim 10 wherein said alarm is audible and second anti-coincidence indication is visual.

* * * * *